US011469067B2

(12) United States Patent
Pamunuwa et al.

(10) Patent No.: US 11,469,067 B2
(45) Date of Patent: Oct. 11, 2022

(54) ELECTROMECHANICAL RELAY WITH DEFORMABLE CONDUCTIVE BEAM AND DRAIN ELECTRODE

(71) Applicant: The University of Bristol, Bristol (GB)

(72) Inventors: Dinesh Pamunuwa, Bristol (GB); Sunil Rana, Bristol (GB)

(73) Assignee: The University of Bristol, Bristol (GB)

( * ) Notice: Subject to any disclaimer, the term of this patent is extended or adjusted under 35 U.S.C. 154(b) by 185 days.

(21) Appl. No.: 16/954,040

(22) PCT Filed: Dec. 20, 2018

(86) PCT No.: PCT/GB2018/053718
§ 371 (c)(1),
(2) Date: Jun. 15, 2020

(87) PCT Pub. No.: WO2019/122896
PCT Pub. Date: Jun. 27, 2019

(65) Prior Publication Data

US 2020/0365355 A1 Nov. 19, 2020

(30) Foreign Application Priority Data

Dec. 21, 2017 (GB) ..... 1721670

(51) Int. Cl.
*H01H 59/00* (2006.01)
*H01H 1/00* (2006.01)

(52) U.S. Cl.
CPC ..... *H01H 59/0009* (2013.01); *H01H 1/0036* (2013.01); *H01H 1/0094* (2013.01); *H01H 2059/0054* (2013.01)

(58) Field of Classification Search
CPC ..... H01H 59/0009; H01H 1/0036; H01H 1/0094; H01H 2059/0054; B81B 2203/01; B81B 2203/0145; B81B 2203/0181
See application file for complete search history.

(56) References Cited

U.S. PATENT DOCUMENTS 6,115,231 A 9/2000 Shirakawa
6,836,029 B2 * 12/2004 Greenberg ..... H01H 59/0009 307/134

(Continued)

FOREIGN PATENT DOCUMENTS

EP 1562207 A1 8/2005
GB 2410371 A 7/2005

(Continued)

OTHER PUBLICATIONS

European Patent Office, PCT International Search Report and Written Opinion, International Application No. PCT/GB2018/053718, dated Apr. 2, 2019, pp. 1-18.

(Continued)

*Primary Examiner* — Vanessa Girardi
(74) *Attorney, Agent, or Firm* — Hunton Andrews Kurth LLP

(57) ABSTRACT

A micro or nano electromechanical relay device (10) comprising a source electrode (204) an electrically conductive beam (202) comprising an arcuate portion (12*a*) coupled to the source electrode by an arm portion, first and second drain electrodes (DE1, DE2) and first and second actuator electrodes (AE1, AE2). The arc of the arcuate portion defines a beam axis (BA). The arcuate portion is mounted for pivotal movement about a pivot axis (PA) which is coaxial or generally coaxial with the beam axis.

20 Claims, 4 Drawing Sheets

(56) References Cited

U.S. PATENT DOCUMENTS

| | | | | |
|---|---|---|---|---|
| 7,558,103 | B2 * | 7/2009 | Nakamura | H01H 1/0094 365/171 |
| 9,041,499 | B2 * | 5/2015 | Despont | H01H 1/0094 335/78 |
| 2009/0261517 | A1 | 10/2009 | Yao | |
| 2013/0140157 | A1 | 6/2013 | Despont | |
| 2014/0059843 | A1 | 3/2014 | Despont et al. | |
| 2014/0264645 | A1 | 9/2014 | Daneman et al. | |

FOREIGN PATENT DOCUMENTS

| | | | |
|---|---|---|---|
| GB | 2497379 | A | 6/2013 |
| GB | 2548164 | A | 9/2017 |
| WO | 9943013 | A1 | 8/1999 |

OTHER PUBLICATIONS

UK Intellectual Property Office, Combined Search and Examination Report Under Sections 17 and 18(3), Application No. GB1721670.6, dated Jun. 22, 2018, pp. 1-9.

D. Grogg et al., "Sensors, 2012", published 2012, IEEE, pp. 1-3, "NEM Switch Technologies for Low-Power Logic Applications".

* cited by examiner

ELECTROMECHANICAL RELAY WITH DEFORMABLE CONDUCTIVE BEAM AND DRAIN ELECTRODE

This application is a U.S. national phase application under 35 U.S.C. § 371 of International Application No. PCT/GB2018/053718, filed Dec. 20, 2018, which claims priority to U.K. Application No. 1721670.6, filed Dec. 21, 2017, the complete disclosure of which is incorporated herein by reference.

BACKGROUND

Transistors are widely used in integrated circuits. However, transistors have a non-zero off-state leakage current and only have a limited range of operating conditions. Thus they can be inefficient when used in low-power circuits and high temperatures. Moreover, ionising radiation can seriously affect device operation.

In some industries it is desirable to substitute transistors with devices that have zero leakage within their entire operational temperature range to improve the battery life of electronic products.

Nano-electromechanical relay can be used as switching elements in lieu of transistors in electronic circuits. They offer zero off-state leakage and their harsh environment operation capability can significantly surpass the capability of transistors. However, known micro or nano-electromechanical relay devices are not practical for use in many applications as they can suffer from premature catastrophic failure.

SUMMARY

In accordance with a first aspect of the invention, there is provided a micro or nano electromechanical relay device comprising a source electrode, an electrically conductive beam comprising an arcuate portion coupled to the source electrode by an arm portion, first and second drain electrodes and first and second actuator electrodes. The arm portion can comprise a flexible hinge portion, the flexible hinge portion being less stiff than the arcuate portion. The arc of the arcuate portion of the beam can be shaped to define a beam axis that is the axis of the arc. The beam can be mounted by the flexible hinge portion. The flexible hinge portion can mount the beam for pivotal movement about a pivot axis which is coaxial with the beam axis or offset from the beam axis such that it is closer to the beam axis than the arcuate portion of the beam so as to be generally coaxial with the beam axis. The first actuator electrode can be arranged to bias the arcuate portion of the beam to pivot about the pivot axis in a first direction into electrical contact with the first drain electrode. The second actuator electrode can be arranged to bias the arcuate portion of the beam to pivot about the pivot axis in a second direction opposite to the first direction into electrical contact with the second drain electrode. The first actuator electrode can have a first arcuate surface facing the arcuate portion of the beam, the first arcuate surface defining a first axis which is coaxial or generally coaxial with respect to the beam axis. The second actuator electrode can have a second arcuate surface facing the arcuate portion of the beam, the second arcuate surface defining a second axis which is coaxial or generally coaxial with respect to the beam axis. The beam can pivot about or generally about the beam axis so that there is a first generally uniform gate gap between the first arcuate surface and the arcuate portion of the beam, and a second generally uniform gate gap between the second arcuate surface and the arcuate portion of the beam. The beam axis can refer to the axis of the arc when the arcuate portion is in a central, at rest condition.

The present inventors have identified that known electromechanical relay devices can suffer from premature catastrophic failure due to the non-uniform air gap(s) separating the beam and actuator electrode(s) when the beam is in contact with the drain electrode. The non-uniform air gap(s) can result in regions with high electric fields, which in turn can lead to the beam contacting an actuator electrode.

An electromechanical relay according to the first aspect addresses the above-mentioned problem by having a beam comprising a circularly arcuate portion that can pivot about or generally about its arc axis when biased, instead of a linear beam that flexes. By shaping the actuator electrodes such that an annularly arcuate air gap centred on the beam axis is defined, the arcuate portion of the beam can pivot to contact the drain electrodes while maintaining constant or generally constant air gaps with respect to the actuator electrodes. As the distance between the actuator electrodes and the arcuate portion can be maintained generally constant during all modes of operation the developed electrostatic forces maintain generally uniform magnitudes which can reduce the likelihood of the beam being drawn into contact with an actuator electrode. Furthermore maintaining a generally constant air gap during all modes of operation can enable minimization of the air gaps, which can lead to a reduction in the actuation voltages needed to be applied to pivot the beam. Thus the electromechanical relay can be more energy efficient than previously known electromechanical relay devices. Furthermore, in a bi-stable relay with two stable operational states a single voltage can be used to transition the relay between operational states, as the air-gap is constant. Thus an electromechanical relay according to the first aspect can be used to build non-volatile computing devices such as electronic memory with architecture and/or control circuitry that is simplified in comparison to known devices.

The terms nano and micro are used in this context to refer to very small electromechanical relays (as is common in electrical or electronic circuitry). Micro can refer to a scale of ten to the power of minus 6 ($10^{-6}$), however in this context it can also refer to a scale slightly larger or smaller than precisely $10^{-6}$, for example $10^{-4}$ or $10^{-7}$. Equally, nano can refer literally to a scale of ten to the power of minus 9 ($10^{-9}$), however in this context it can also refer to a scale slightly larger or smaller than precisely $10^{-9}$, for example $10^{-8}$ or $10^{-11}$.

The first and/or second drain electrodes can be provided with elastically deformable regions arranged to deform when in contact with ends of the arcuate portion of the beam, so as to conform to the shape of the ends of the arcuate portion.

The ends of the arcuate portion of the beam can be provided with elastically deformable regions arranged to conform to the shape of contact regions of the first and/or second drain electrodes.

In both cases the elastically deformable regions can improve and/or help to control stiction, which can be affected by manufacturing tolerances, and/or can reduce the impact force between the beam the and drain electrodes upon contact.

The arcuate portion of the beam can be configured to be of greater size, volume and/or mass in comparison to the arm portion. This can improve the non-volatile nature of the relay device, when the beam remains in one of two stable operational states.

The arc of the arcuate portion can extend by at least 90° and in some cases by around 180° to define a semi-circular beam.

The arm portion can be coupled to an arcuate side of the arcuate portion, so as to bifurcate the arcuate portion. The arm can couple to the longitudinal centre of the arcuate side so that the bifurcated portions of the arcuate portion are of equal size.

The electromechanical relay can have the first gate gap equal to the second gate gap.

In known electromechanical relays the air gaps between the beam and the actuator electrodes change depending on the state of the relay, thus requiring different voltage differentials to be applied between the actuator electrodes and the beam when the beam is to be biased for the first time towards a stable state, commonly referred to as 'programming voltage', and when the beam is biased to transition from one stable state to the second stable state, commonly referred to as 're-programming voltage'. Having consistent air gaps during all modes of operation may lead to the programming voltage being equal to the re-programming voltage, thus greatly simplifying the circuits that supply voltages to the components of the relay. A single actuation voltage in combination with the improved stiction due to the deformable contacts can allow for more reliable operation of the relay over a greater number of cycles compared with known electromechanical relays.

The electromechanical relay can comprise third and/or fourth actuator electrodes arranged to bias the beam to pivot about the beam axis in the first and/or second direction such that the surfaces of the third and fourth electrodes facing the beam are circularly arcuate and defining a plurality of axes which are generally coaxial with respect to the beam axis, such that there are respective third and/or fourth gate gaps between the arcuate portion and the respective actuator electrodes(s).

The actuator electrodes can be configured such that the vector sum of the electrostatic forces applied to the beam is tangential to the arc of the arcuate portion, thus defining a moment that generates the rotational motion of the beam about or generally about the pivot axis.

The beam can be mounted for rotation about the pivot axis by the flexible hinge portion so that the motion of the arcuate portion approximates a circular rotation around the pivot axis.

When the beam is positioned mid-way between the two operational states, the distance between the ends of the arcuate portion of the beam and the drain electrodes can be equal to at least one of the gate gaps and in some cases all of the gate gaps. Thus, when the beam is in a central position, between operational states, first and second end gaps exist which can have the same thickness as the gate gaps. The thickness of the end gaps can be such that the beam rotates less than 1° and in some cases less than 0.1° in order to move between the first and second operational states.

The first and second actuator electrodes can be disposed between the arcuate portion and the beam axis, one on either side of the arm portion. Thus, first and second arm movement gaps exist, one on either side of the arm portion. When the beam is in a central position, between operational states, the arm movement gaps can be of greater thickness than the gate gaps and/or end gaps, and it is preferred that the arm movement gaps are at least twice the thickness of the gate gaps and/or end gaps. This can reduce the electrostatic force between the actuator electrodes and the arm portion, and the force gradient along the arm portion, to a negligible amount, despite the non-uniformity of the arm movement gaps in use.

In accordance with a second aspect of the invention, there is provided a micro or nano electromechanical relay comprising a source electrode, an electrically conductive beam electrically coupled to the source electrode, a first drain electrode, and a first actuator electrode. The relay can have the first actuator electrode arranged to bias the beam to deflect about its mounting axis and/or its longitudinal axis in a first direction into electrical contact with the first drain electrode. In order to increase the contact surface area between the beam and the first drain electrode, the relay can have the beam comprise an elastically deformable region arranged to conform to the shape of the first drain electrode and/or the first drain electrode comprise an elastically deformable region arranged to deform when in contact the beam, to conform to the shape of the beam.

The electromechanical relay according to the second aspect is therefore provided with one or more elastically deformable regions which serve to increase the electrical contact area between the beam and drain electrodes. This can provide more control over stiction, which can be advantageous in non-volatile applications for example, and increase reliability in general.

The electromechanical relay can comprise a second actuator electrode arranged to bias the beam to deflect in a second direction opposite to the first direction into electrical contact with a second drain electrode. In order to increase the contact surface area between the beam and the second drain electrode, the electromechanical relay can have the beam comprise an elastically deformable region arranged to conform to the shape of the second drain electrode and/or the second drain electrode comprise an elastically deformable region arranged to deform when in contact the beam, to conform to the shape of the beam.

The beam and the source electrode can be integrally formed as a single unit.

Optional features of the first aspect can be applied analogously to the second aspect.

In accordance with a third aspect of the invention, there is provided a non-volatile computing device comprising one or more electromechanical relays according to the first and/or second aspect of the invention.

The non-volatile computing device according to the third aspect can be used as a memory element.

DESCRIPTION

Figure 1C:
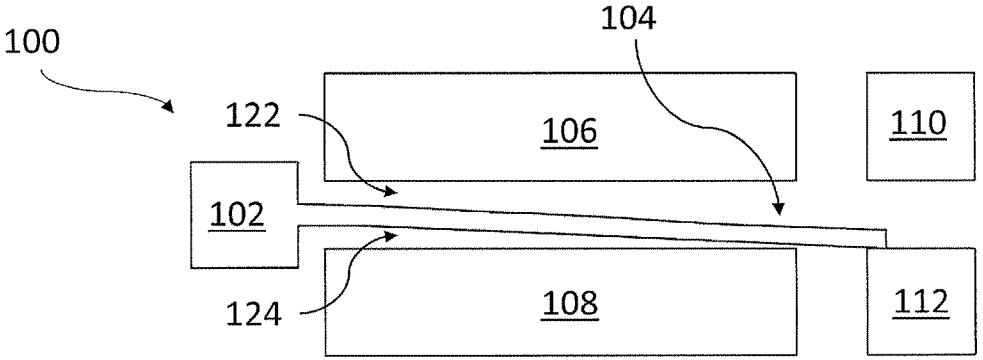
FIGS. 1A to 1C show a known electromechanical relay device.
Figure 1B:
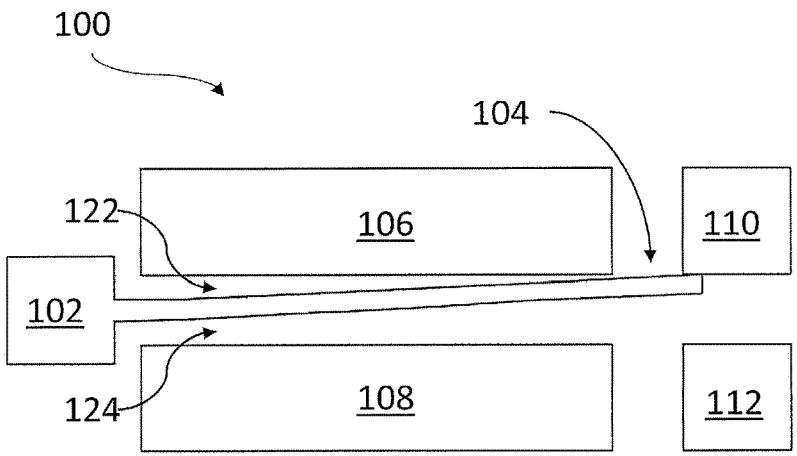
Figure 1A:
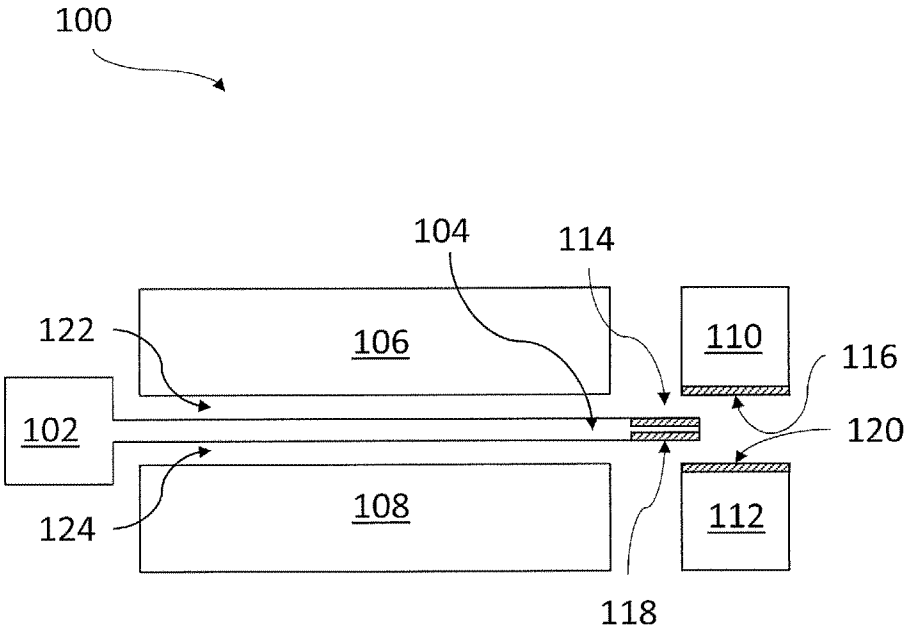

In FIG. 1A, an example of a known electromechanical relay device is shown generally at 100. The electromechanical relay device has a source electrode 102, which is an input terminal, connected to a first voltage source (not shown). A linear beam 104 is attached at one end to the source and has a free end at an opposite end of the beam 104. The electromechanical relay further includes a first actuator electrode 106 on a first side of the beam and a second actuator electrode 108 on a second side of the beam.

The first actuator electrode 106 is separated by the beam 104 by a first air gap 122 and the second actuator electrode 108 is separated by the beam 104 by a second air gap 124. The first actuator electrode is connected to a first actuator voltage source (not shown) and the second actuator electrode is connected to a second actuator voltage source (not shown). The electromechanical relay device 100 further includes a first drain electrode 110, which is an output terminal, located on the first side of the beam, and a second drain electrode 112, which is an output terminal, located on the second side of the beam.

In FIG. 1A the electromechanical relay device is in a first state in which the first and second air gaps 122, 124 are of equal, uniform size. The first state is an "off" state.

The electromechanical relay device 100 can be operated to a second state as shown in FIG. 1B in which the beam 104 contacts the first drain electrode 110 or a third state as shown in FIG. 1C in which the beam 104 contacts the second drain electrode 112.

In order to cause the electromechanical relay device 100 to transition to the second state, a voltage differential is applied between the beam 104 and the first actuator electrode 106, causing the beam 104 to bend towards the first drain electrode 110, until a first contact 114 located on the free end of the beam 104 makes contact with a third contact 116 located on the first drain electrode 110. In order to cause the electromechanical relay device 100 to transition to the third state, a voltage differential is applied between the beam 104 and the second actuator electrode 108, causing the beam 104 to bend towards the second drain electrode 112, until a second contact 118 located on the free end of the beam 104 makes contact with a fourth contact 120 located on the second drain electrode 112.

When the electromechanical relay device 100 is in the second state or the third state the air gaps 122, 124 between the beam 104 and the first actuator electrode 106 and the second actuator electrode 108 are not uniform over the length of the beam. The uneven air gaps result in non-uniform distribution of the electric field with the strongest field in the smallest gap and hence causes uneven electrostatic forces applied over the length of the beam. This can lead to the beam contacting on an actuator electrode which can contribute to catastrophic failure after a premature number of state transitions. Furthermore, as the air gaps change when the beam transitions between the first, second and third state, the minimum required actuation voltage changes as a function of the rest position of the beam, restricting the minimum voltage with which the relay device can be switched, increasing its energy consumption.

Figure 2:
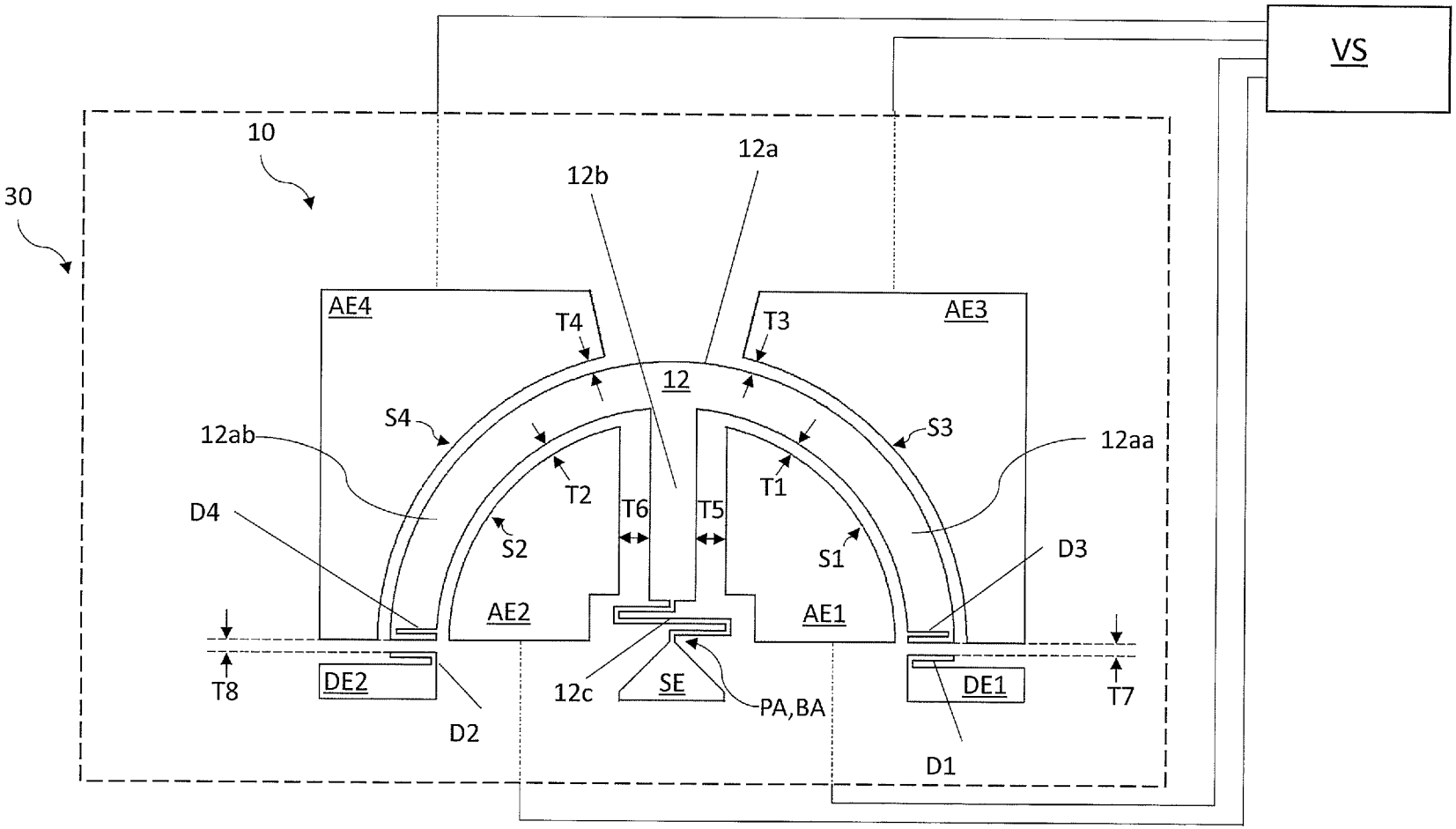
FIG. 2 shows a micro or nano electromechanical relay according to an embodiment of the present invention.

In FIG. 2 a micro or nano electromechanical relay according to a first embodiment of the present invention is shown generally at 10. The electromechanical relay 10 has spatial dimensions in the order of magnitude of micrometres or nanometres.

The electromechanical relay 10 comprises an electrically conductive beam 12 coupled to a source electrode SE so that the beam 12 can pivot in a first direction about a pivot axis PA into electrical contact with a first drain electrode DE1 and pivot in a second, opposite direction about the pivot axis PA into electrical contact with a second drain electrode DE2. These will be referred to as the "first" and "second" operational states, respectively. Thus, when the beam 12 is moving towards or is in contact with first drain electrode DE1 the relay 10 is in the first operational state. Likewise, when the beam 12 is moving towards or is in contact with the second drain electrode DE2 the relay 10 is in the second operational state.

The beam 12 and the source electrode SE can be integrally formed as a single unit.

The beam 12 comprises a generally arcuate portion 12*a* which is pivotally coupled to the drain electrode via an arm portion 12*b*. The base of the arm portion 12*b* includes or is coupled to a flexible hinge portion 12*c* which is less stiff than the arcuate portion 12*a* and optionally also the rest of the arm portion 12*b*. In this embodiment the flexible hinge portion 12*c* defines the pivot axis PA of the beam 12.

The arcuate portion 12*a* is shaped so as to define a beam axis BA, which is the axis of the arc of the arcuate portion 12*a*. The arcuate portion 12*a* has first and second arcuate surfaces with common axes BA to define a constant thickness W between them.

In this embodiment the relay 10 is arranged such that the beam axis BA is coaxial with the pivot axis PA. Thus, as the beam 12 pivots about the pivot axis PA and the coaxial beam axis BA, the arcuate portion 12*a* moves in a circumferential manner to define an annular swept volume the width of which is generally equal to the thickness W of the arcuate portion 12*a*.

In other embodiments, the pivot axis PA is not coaxial with the beam axis BA, but rather can be generally coaxial in that the pivot axis PA is spaced from the beam axis BA but located closer to the beam axis BA than the arcuate portion 12*a*. For example, the pivot axis can be positioned at a point along the arm portion. In such embodiments the actuate portion 12*a* is said to pivot generally about the beam axis BA. While this may lead to a deviation in the rotation of the beam 12 around the beam axis BA from a strictly circular locus, it can significantly reduce the switching voltage. Advantageously, locating the pivot axis PA closer to the beam axis BA enables the air gaps generally found in the relay 10 between the beam and the electrodes to be smaller.

In some embodiments the relay 10 can be arranged so as to define a pivot axis that moves as the beam transitions between operational states; for example, the flexible hinge portion 12*c* may not define a stationary pivot point, but rather may result in a moving pivot axis, which moves within a pivot region. Pivot axis deviation can be proportional to the hinge length and the rotational displacement. However, again, the relay in such embodiments is arranged such that the actuate portion 12*a* is said to pivot generally about the beam axis BA.

In the illustrated embodiment the arcuate portion 12*a* comprises a first section 12*aa* and a second section 12*ab* that together, in series, form the arcuate portion 12*a*. The arcuate portion 12*a* is semi-circular, but can define an arc which is greater or less than a semicircle. The arm portion 12*b* extends radially inwardly from the region where the first and second sections 12*aa*, 12*ab* meet. The arm portion 12*b* is a generally linear member but can take any suitable shape.

The arcuate portion 12*c* can be configured to be of greater size, volume and/or mass in comparison to the arm portion 12*b*. This can improve the non-volatile nature of the relay device 10.

In the illustrated embodiment the beam 12 is arranged to be actuated between the first and second operational states by a set of four actuator electrodes: a first actuator electrode AE1, a second actuator electrode AE2, a third actuator electrode AE3, and a fourth actuator electrode AE4. The actuator electrodes work in pairs.

The first actuator electrode AE1 has a first arcuate surface S1 disposed radially inwardly with respect to and facing the first section 12*aa* of the arcuate portion 12*a*, the first arcuate surface S1 defining a first axis (not shown) which in this embodiment is generally coaxial with respect to the beam axis BA. The first actuator electrode AE1 is arranged such that there is a first gate gap T1 between the surface S1 and the arcuate portion 12*a*.

The second actuator electrode AE2 has a second arcuate surface S2 disposed radially inwardly with respect to and facing the second section 12*ab* of the arcuate portion 12*a*, the second arcuate surface S2 defining a second axis (not shown) which is generally coaxial with respect to the beam axis BA. The second actuator electrode AE2 is arranged such that there is a second gate gap T2 between the surface S2 and the arcuate portion 12*a*.

The third actuator electrode AE3 has a third arcuate surface S3 disposed radially outwardly with respect to and facing the first section 12*aa* of the arcuate portion 12*a*, the third arcuate surface S3 defining a third axis (not shown) which is generally coaxial with respect to the beam axis BA. The third actuator electrode AE3 is arranged such that there is a third gate gap T3 between the surface S3 and the arcuate portion 12*a*.

The fourth actuator electrode AE4 has a fourth arcuate surface S4 disposed radially outwardly with respect to and facing the second section 12*ab* of the arcuate portion 12*a*, the fourth arcuate surface S4 defining a fourth axis (not shown) which is generally coaxial with respect to the beam axis BA. The fourth actuator electrode AE4 is arranged such that there is a fourth gate gap T4 between the surface S4 and the arcuate portion 12*a*.

When the beam is positioned mid-way between the drain electrodes DE1, DE2, the first end gap T7 between the first portion 12*aa* and the first drain electrode DE1 is equal to the second end gap T8 between the second portion 12*ab* and the second drain electrode DE2, but this need not be the case.

In the illustrated embodiment the first gate gap T1, the second gate gap T2, the third gate gap T3, the fourth gate gap T4, the first end gap T7, and the second end gap T8 are all equal to each other, but this need not be the case. The end gaps T7, T8 can advantageously be smaller than the gate gaps, further reducing the chance of the beam making contact with one of the gates in use.

The first actuator electrode AE1 and the fourth actuator electrode AE4 are arranged to bias the beam 12 to adopt the first operational state by applying respectively a first and fourth voltage differential between the beam 12 on the one hand and the respective electrodes AE1, AE4 on the other hand, such that the beam 12 pivots about the beam axis PA in a first direction into electrical contact with the first drain electrode DE1.

The second actuator electrode AE2 and the third actuator electrode AE3 are arranged to bias the beam 12 to adopt the second operational state by applying respectively a second and third voltage differential between the beam 12 on the one hand and the respective actuator electrodes AE2, AE3 on the other hand, such that the beam 12 pivots about the beam axis PA in a second direction opposite to the first direction into electrical contact with the second drain electrode DE2.

In view of the fact that the beam 12 pivots about or generally about the beam axis BA and given that the arcuate surfaces S1, S2, S3, S4 of the actuator electrodes AE1, AE2, AE3, AE4, the gate gaps T1, T2, T3, T4 each remain in a generally uniform state as the beam 12 transitions between operational states. This can make the relay 10 more robust against premature failure.

The first, second, third, and fourth voltage differentials may be supplied to the relay by a voltage source circuit VS coupled to the relay 10. The voltage source circuit VS can for example comprise a battery and associated circuitry for controlling voltage differentials applied between the source and gate electrodes.

The voltage source VS and one or more relays 10 can form a non-volatile computing device 30 such as electronic memory.

Advantageously, the uniform gate gaps of embodiments of the invention enable a single voltage, such as 4 Volts, to be used to drive the relay 10 between operational states. Alternatively, the voltage source VS can be arranged to supply different values, or any combination of voltage values that results in the beam pivoting in the first or the second direction about the beam axis BA.

The first, second, third, and fourth voltage differentials can be configured such that the vector sum of the electrostatic forces applied to the beam is tangential to the arc of the arcuate portion 12*a*, thus defining a moment that generates the rotational motion of the beam about the beam axis. The arc can refer to the inner or outer arcuate surface, or a central arc. Hence the electromechanical relay 10 can be a moment driven relay in contrast to known electromechanical relays which are primarily force driven for deflection.

While the air gaps T5, T6 on either side of the arm portion 12*b* will vary in use due to the pivoting motion of the arm portion 12*b*, the thickness of these air gaps T5, T6 are larger than the other air gaps and can be at least twice that of the gate gaps T1 to T4 and/or T7 and T8, resulting in reduced magnitude of and variation in the electrostatic forces applied to the arm portion 12*b* in use.

In further embodiments of the present invention the relay can comprise more than four actuator electrodes, and in some embodiments just two.

In some embodiments the motion of the arcuate portion 12*a* can approximate a spiralling rotation around the pivot axis 224. The hinge portion 12*c* can allow both horizontal and vertical movement, and moving the pivot axis PA up towards the arcuate portion 12*a* accentuates non-circular rotation. There is a design trade-off between achieving perfectly rotational motion (with perfectly uniform airgap) and reducing actuation voltage by moving the pivot point up (which reduces the force components opposing the rotational moment).

The relay 10 can be provided with elastically deformable regions D1, D2, D3, D4 where the beam 12 contacts the drain electrodes DE1, DE2 in order to improve stiction, to help the beam 12 to remain in one of the operational states following removal of an actuation voltage.

Figure 3:
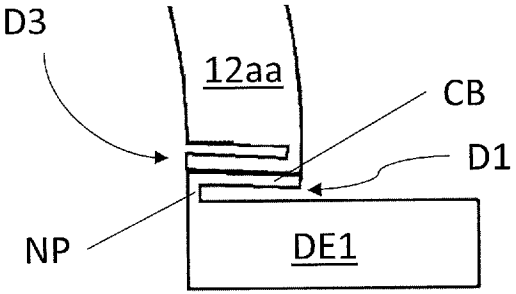
FIG. 3 shows part of the beam and a drain electrode of the relay of FIG. 2.

Referring additionally to FIG. 3, the free end of the first section 12*aa* is provided with a radially extending slot to define an elastically deformable first cantilevered region D3 arranged to deform in use under the applied electrostatic force to conform to a contact surface of the first drain electrode DE1. The first drain electrode DE1 can be provided with a similar but oppositely orientated elastically deformable cantilevered region D1 to aid in surface conformation. The deformable regions D1, D3 are thus shaped and arranged such that a generally downward force on portion 12*aa* of the beam resulting in a generally downward motion can deform the regions D1, D3 in a compliant manner. The regions D1, D3 conform to the shape of the opposing contact face such that there is an increase of the surface area in contact. As illustrated in FIG. 3, the deformable regions can each comprise a neck portion NP and a cantilever portion CP, the cantilever beam portion CB extending in a right angle from the neck portion NP. It will however be appreciated that other geometrical arrangements can be used, such as serpentine springs instead of cantilevers.

By increasing the contact area between the beam 12 and a drain electrode as shown in FIG. 3, the developed stiction can be sufficient to maintain the beam 12 connected to the drain electrode DE1, DE2 without the need for continuous application of a voltage differential to the relay 10. Thus, the electromechanical relay 10 can be non-volatile. The deformable regions can also help to reduce the electrical resistance between the beam 12 and the drain electrodes DE1, DE2.

Increasing the contact area can also be aided by shaping the contact ends such that they are complementary when in contact. However, when the dimensions of an electromechanical device are in the order of magnitude of micrometres or nanometres, fine shaping the components of a device is extremely difficult due to limitations of lithography and etch techniques. Hence, it is extremely difficult to ensure that the contact areas of two electrodes are complementary. By making the ends deformable as described above, it can increase the likelihood that when enough biasing force is applied the deformable regions will conform, thereby increasing the contact surface.

Likewise, the free end of the second section 12*ab* is provided with an elastically deformable second cantilevered region D4 which is a mirror opposite of the first cantilevered region D3 and the second drain electrode DE2 is provided with an oppositely orientated elastically deformable fourth cantilevered region D2 to aid in surface conformation.

In further embodiments, just one of the beam ends and drain electrodes DE1, DE2 can be provided with elastically deformable regions and in other embodiments the relay 10 does not include any elastically deformable regions. Where elastically deformable regions are provided, they can be implemented in any suitable manner.

An electromechanical relay according to embodiments of the invention can maintain during all modes of operation a uniform air gap between the beam 10 and the plurality of actuator electrodes. Thus the effect of the developed electrostatic forces on the beam is uniform, which greatly increases the longevity of the electromechanical relay.

Figure 4:
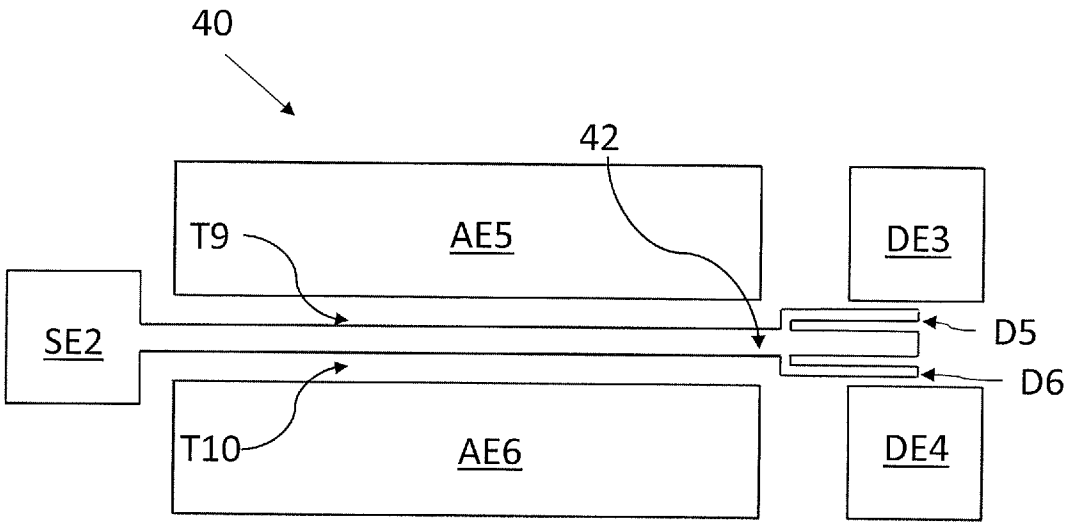
FIG. 4 shows a micro or nano electromechanical relay according to a further embodiment of the present invention.

It should be noted that embodiments of the invention extend to micro or nano electromechanical relay devices having elastically deformable contact regions but not having the arcuate portion 12*a* and constant air gap configuration described with reference to FIG. 2. FIG. 4 is a diagram of such a micro or nano electromechanical relay device 40 according to such an embodiment of the present invention.

The electromechanical relay device 40 has a source electrode SE2, which is an input terminal, connected to a first voltage source (not shown). A beam 42 is attached at one end to the source SE2 and has a free end at an opposite end of the beam 42. The electromechanical relay 40 further includes a first actuator electrode AE5 on a first side of the beam 42 and can have a second actuator electrode AE6 on a second side of the beam 42, opposite to the first side. The first actuator electrode AE5 is separated from the beam 42 by an air gap T9 and the second actuator electrode AE6 is separated from the beam 42 by an air gap T10. The first actuator electrode is connected to a first actuator voltage source (not shown) and the second actuator electrode can be connected to a second actuator voltage source (not shown). The electromechanical relay device 40 further includes a first drain electrode DE3, which is an output terminal, located on the first side of the beam, and can include a second drain electrode DE4, which can be an output terminal, located on the second side of the beam. The free end of the linear beam 42 comprises an elastically deformable region D5 facing the first drain electrode DE3 and can comprise an elastically deformable region D6 facing the second drain electrode DE4.

The elastically deformable region D5 is shaped and configured such that the biasing force from the actuator electrode AE5 can deform the region D5 such that the region D5 conforms to the shape of the first drain electrode DE3 when in contact such that there is an increase of the contact area. The elastically deformable region D6 is shaped and configured such that the biasing force from the actuator electrode AE6 can deform the region D6 such that the region D6 conforms to the shape of the second drain electrode DE4 when in contact, such that there is an increase of the contact area. In other embodiments the elastically deformable regions can be additionally or alternatively provided on the drain electrodes DE3, DE4. Where elastically deformable regions are provided, they can be implemented in any suitable manner.

Nano-electromechanical relays according to embodiments of the invention can be used as switching elements in lieu of transistors in non-volatile electronic circuits such as memory elements. Known electromechanical relays are unsuitable for such use as they require constant supply of actuating voltage to retain their programmed state. In contrast to those, embodiments of the present invention can remain in their programmed state even when the actuator electrodes are not exerting any electrostatic forces on the beam due to their improved control over the stiction developed between the beam and the drain electrodes. Thus, embodiments of the present invention, apart from surpassing known electromechanical relays in terms of reliability, also enable the use of electromechanical relays for non-volatile applications such as computer memory. Furthermore, the constant air gap in some embodiments provides for actuation from any state with the same actuation voltage, resulting in identical or near identical programming, reprogramming, and read-out voltages, yielding a commercial advantage over other technologies that require multiple voltage levels.

Electromechanical relays according to any embodiment of the invention can for example be fabricated from monocrystalline silicon. Alternatively other materials with similar electromechanical properties can be used, such as polycrystalline silicon, metals and silicon nitride.

Although the invention has been described above with reference to one or more preferred embodiments, it will be appreciated that various changes or modifications can be made without departing from the scope of the invention as defined in the appended claims. The word "comprising" can mean "including" or "consisting of" and therefore does not exclude the presence of elements or steps other than those listed in any claim or the specification as a whole. The mere fact that certain measures are recited in mutually different dependent claims does not indicate that a combination of these measures cannot be used to advantage.

The invention claimed is:

1. A micro or nano electromechanical relay device comprising:

a source electrode;

an electrically conductive beam comprising an arcuate portion coupled to the source electrode by an arm portion;

first and second drain electrodes; and first and second actuator electrodes, wherein:

the arc of the arcuate portion defines a beam axis;

the arcuate portion is mounted for pivotal movement about a pivot axis which is coaxial or generally coaxial with the beam axis;

the first actuator electrode is arranged to bias the arcuate portion to pivot about the pivot axis in a first direction into electrical contact with the first drain electrode;

the second actuator electrode is arranged to bias the arcuate portion to pivot about the pivot axis in a second direction opposite to the first direction into electrical contact with the second drain electrode;

the first actuator electrode has a first arcuate surface facing the arcuate portion, the first arcuate surface defining a first axis which is generally coaxial with respect to the beam axis; and the second actuator electrode has a second arcuate surface facing the arcuate portion, the second arcuate surface defining a second axis which is generally coaxial with respect to the beam axis, such that while the arcuate portion pivots about the pivot axis there is a first generally uniform gate gap between the first arcuate surface and the arcuate portion, and a second generally uniform gate gap between the second arcuate surface and the arcuate portion, wherein the first gate gap and the second gate gap are constant during all modes of operation.

2. A device according to claim 1 wherein at least one of the first and second drain electrodes comprises deformable regions arranged to deform when in contact with ends of the arcuate portion, to conform to the shape of the ends of the beam.

3. A device according to claim 1 wherein ends of the arcuate portion comprise elastically deformable regions arranged to conform to the shape of the first or second drain electrode.

4. A device according to claim 1 wherein the arcuate portion is greater in at least one of the set consisting of size, volume, and mass in comparison to the arm portion.

5. A device according to claim 1 wherein the arcuate portion is semi-circular or the arm portion is coupled to an arcuate side of the arcuate portion, so as to bifurcate the arcuate portion.

6. A device according to claim 1 wherein the first gate gap is equal to the second gate gap.

7. A device according to claim 1 further comprising third or fourth actuator electrodes arranged to bias the beam to pivot about the beam axis in the first or second direction respectively such that the surfaces of the third and fourth electrodes facing the arcuate portion are arcuate and define axes which are generally coaxial with respect to the beam axis, such that there is a gate gap between the arcuate portion and the third or fourth actuator electrodes that remains generally constant while the arcuate portion pivots about the beam axis.

8. A device according to claim 1, wherein the actuator electrodes are configured such that the vector sum of the electrostatic forces applied to the beam is tangential to the arc of the arcuate portion, defining a moment that generates the rotational motion of the arcuate portion about the beam axis.

9. A device according to claim 1 wherein the arm portion includes or is coupled to a flexible hinge portion, the flexible hinge portion being less stiff than the arcuate portion, the flexible hinge portion being arranged so that the motion of the arcuate portion approximates a circular rotation around the beam axis.

10. A device according to claim 1 wherein the distance between the ends of the beam and the drain electrodes when the beam is positioned mid-way between them is equal to at least one of the gate gaps.

11. A device according to claim 1, wherein the first and second actuator electrodes are disposed between the arcuate portion and the beam axis, one on either side of the arm portion to define arm movement gaps of greater thickness than at least one of the set consisting of the gate gaps and the end gaps.

12. A device according to claim 1 wherein the arcuate portion is semi-circular and the arm portion is coupled to an arcuate side of the arcuate portion, so as to bifurcate the arcuate portion.

13. A device according to claim 1 further comprising third and fourth actuator electrodes arranged to bias the beam to pivot about the beam axis in the first and second direction respectively such that the surfaces of the third and fourth electrodes facing the arcuate portion are arcuate and define axes which are generally coaxial with respect to the beam axis, such that there is a gate gap between the arcuate portion and the third and fourth actuator electrodes that remains generally constant while the arcuate portion pivots about the beam axis.

14. A device according to claim 1, wherein:

the beam comprises an elastically deformable region arranged to conform to the shape of the first drain electrode or the first drain electrode comprises an elastically deformable region arranged to deform when in contact with the beam, to conform to the shape of the beam, to increase the contact surface area between the beam and the first drain electrode.

15. A device according to claim 14 wherein the beam comprises an elastically deformable region arranged to conform to the shape of the second drain electrode or the second drain electrode comprises an elastically deformable region arranged to deform when in contact with the beam, to conform to the shape of the beam, to increase the contact surface area between the beam and the second drain electrode.

16. A non-volatile computing device comprising:

one or more electromechanical relay devices each comprising a source electrode, an electrically conductive beam comprising an arcuate portion coupled to the source electrode by an arm portion, first and second drain electrodes, and first and second actuator electrodes, wherein:

the arc of the arcuate portion defines a beam axis, the arcuate portion is mounted for pivotal movement about a pivot axis which is coaxial or generally coaxial with the beam axis, the first actuator electrode is arranged to bias the arcuate portion to pivot about the pivot axis in a first direction into electrical contact with the first drain electrode, the second actuator electrode is arranged to bias the arcuate portion to pivot about the pivot axis in a second direction opposite to the first direction into electrical contact with the second drain electrode, the first actuator electrode has a first arcuate surface facing the arcuate portion, the first arcuate surface defining a first axis which is generally coaxial with respect to the beam axis, and the second actuator electrode has a second arcuate surface facing the arcuate portion, the second arcuate surface defining a second axis which is generally coaxial with respect to the beam axis, such that while the arcuate portion pivots about the pivot axis there is a first generally uniform gate gap between the first arcuate surface and the arcuate portion, and a second generally uniform gate gap between the second arcuate surface and the arcuate portion, wherein the first gate gap and the second gate gap are constant during all modes of operation.

17. A non-volatile computing device according to claim 16 coupled to a voltage source, the voltage source being coupled to the source electrode and actuator electrodes of the one or more electromechanical relay devices and being configured to apply a single voltage to the electrodes to switch one or more electromechanical relay devices between operational states.

18. A non-volatile computing device according to claim 16, wherein the non-volatile computing device comprises a computer memory device.

19. A non-volatile computing device according to claim 16, wherein the beam comprises an elastically deformable region arranged to conform to the shape of the first drain electrode or the first drain electrode comprises an elastically deformable region arranged to deform when in contact with the beam, to conform to the shape of the beam, to increase the contact surface area between the beam and the first drain electrode.

20. A non-volatile computing device according to claim 19, wherein the beam comprises an elastically deformable region arranged to conform to the shape of the second drain electrode or the second drain electrode comprises an elastically deformable region arranged to deform when in contact with the beam, to conform to the shape of the beam, to increase the contact surface area between the beam and the second drain electrode.

* * * * *